US011458531B2

(12) United States Patent
Suezawa et al.

(10) Patent No.: US 11,458,531 B2
(45) **Date of Patent: *Oct. 4, 2022**

(54) CASTING MOLD

(71) Applicant: HONDA MOTOR CO., LTD., Tokyo (JP)

(72) Inventors: Takuji Suezawa, Tokyo (JP); Shinji Sangawa, Tokyo (JP); Toshiaki Onuma, Tokyo (JP); Hiroshi Ichikawa, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/407,199

(22) Filed: Aug. 20, 2021

(65) Prior Publication Data

US 2022/0055094 A1 Feb. 24, 2022

(30) Foreign Application Priority Data

Aug. 24, 2020 (JP) ..... JP2020-140941

(51) Int. Cl.
*B22C 9/08* (2006.01)
*B22C 9/06* (2006.01)

(52) U.S. Cl.
CPC . *B22C 9/08* (2013.01); *B22C 9/06* (2013.01)

(58) Field of Classification Search
CPC .. B22C 9/06; B22C 9/08; B22C 9/082; B22D 35/04
See application file for complete search history.

(56) References Cited

FOREIGN PATENT DOCUMENTS

| | | |
|---|---|---|
| JP | 07-060398 | 3/1995 |
| JP | 2004-090063 | 3/2004 |
| JP | 6029444 | 11/2016 |

*Primary Examiner* — Kevin P Kerns
*Assistant Examiner* — Steven S Ha
(74) *Attorney, Agent, or Firm* — Amin, Turocy & Watson, LLP

(57) ABSTRACT

A casting mold includes a cavity for molding a product, and a pouring basin and a passageway that guide molten metal into the cavity. The passageway includes, at portions thereof positioned below the pouring basin and the cavity, bent portions (a first bent portion, a second bent portion) that change the advancing direction of the molten metal, and the casting mold further includes a cover member, which covers the inner wall of the bent portion, allows the passageway positioned on the upstream side of the bent portion to communicate with the passageway positioned on the downstream side of the bent portion, and has a lower thermal conductivity than the base material of the mold.

5 Claims, 17 Drawing Sheets

72
78
82
82
A
74
Y
X
Z 72
78
A
82
74
80
76
84
X
Z
Y 72
78
A
82
82
74
80
80
84
76
VIII
VIII
Y
Z
X

CASTING MOLD

CROSS-REFERENCE TO RELATED APPLICATION

This application is based upon and claims the benefit of priority from Japanese Patent Application No. 2020-140941 filed on Aug. 24, 2020, the contents of which are incorporated herein by reference.

BACKGROUND OF THE INVENTION

Field of the Invention

The present invention relates to a casting mold used in casting.

Description of the Related Art

Various metal products are used for power trains or the like of a vehicle. For example, metal products are formed by casting. JP 6029444 B2 discloses a casting mold used in a gravity casting method or a low pressure casting method. This casting mold includes a branch portion forming body made of a tungsten alloy on the upstream side of a branch point. This structure improves the heat resistance of the portion upstream of the branch point.

SUMMARY OF THE INVENTION

The passageway (corresponding to the sprue, the runner, and the gate) of the casting mold is heated by molten metal and expands. Further, the passageway of the casting mold is cooled by a cooling device and shrinks. When the casting mold is constrained, the inner wall of the passageway is compressed as the mold expands. Therefore, the inner wall of the passageway is easily deformed. Further, the inner wall of the passageway is pulled out along with the shrinkage of the mold. Therefore, the inner wall of the passageway is likely to crack.

In the passageway, the molten metal is less likely to flow in the bent portion where the advancing direction of the molten metal is changed to the lateral direction or the upward direction, than in portions other than the bent portion. Therefore, the temperature of the bent portion becomes higher than that of the portions other than the bent portion. In particular, the bent portion immediately below the pouring basin has the highest temperature. Therefore, cracks tend to occur in the bent portion. When the crack extends, penetration into the crack (a phenomenon in which molten metal enters the crack) occurs. Then, the solidified metal adheres to the inner wall of the bent portion. In this case, maintenance work for removing the adhered metal and maintenance work for filling the crack are required. During maintenance work, the casting mold is out of operation. Therefore, the production amount of the product is reduced. An object of the present invention is to solve the above-described problems.

An aspect of the invention is a casting mold comprising a cavity configured to mold a product, and a pouring basin and a passageway that are configured to guide molten metal into the cavity, wherein the passageway includes, at a portion thereof positioned below the pouring basin and the cavity, at least one bent portion configured to change an advancing direction of the molten metal, and the casting mold further comprises a cover member configured to cover an inner wall of the bent portion and allow the passageway positioned on an upstream side of the bent portion to communicate with the passageway positioned on a downstream side of the bent portion, the cover member having a lower thermal conductivity than a base material of the mold.

According to the present invention, it is possible to reduce the number of maintenance operations due to adhesion of metal.

The above and other objects features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
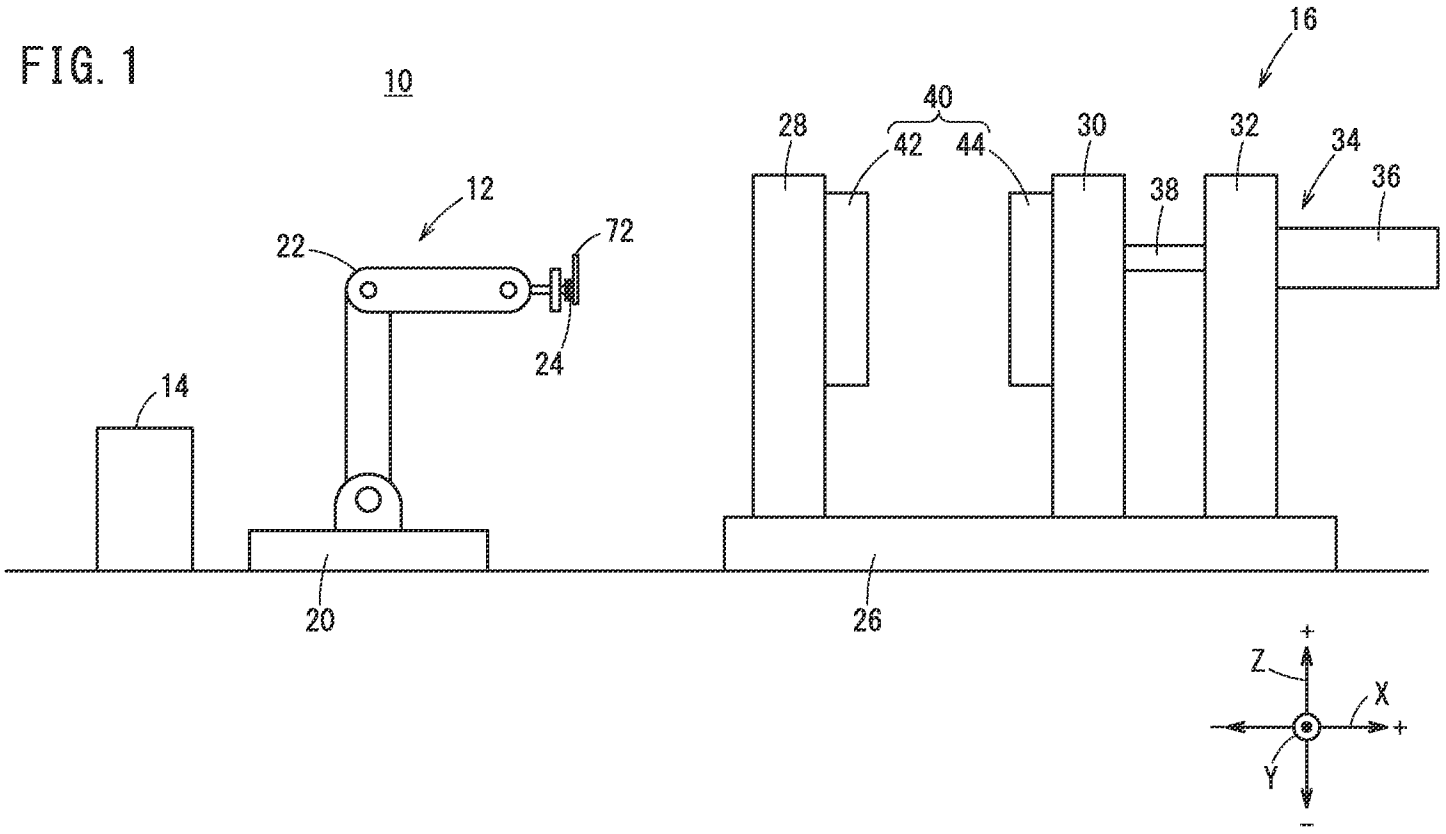
FIG. 1 is a view showing an overall configuration of an insert mounting device.

In the following description, directions such as an X direction, a Y direction, and a Z direction are used. The X direction and the Y direction are orthogonal to each other. The X direction and the Y direction are parallel to the horizontal direction. The Z direction is orthogonal to the X direction and the Y direction. The Z direction is parallel to the up-down direction (vertical direction). The forward direction of each direction is defined as +, and the reverse direction thereof is defined as −.

[1. Insert Mounting Device 10]

An insert mounting device 10 will be described with reference to FIG. 1. The insert mounting device 10 mounts an insert in a casting mold 40 by using a robot 12. In the present embodiment, the insert mounted in the casting mold 40 is a cover member 72.

The insert mounting device 10 includes the robot 12, a controller 14, and a casting machine 16. In FIG. 1, the robot 12 and the casting machine 16 are shown separated from each other. However, the robot 12 is actually disposed at a position where a hand 24 can reach the casting mold 40.

[2. Robot 12]

The robot 12 is an industrial robot. The robot 12 includes a robot base 20, an arm 22, and the hand (gripping portion) 24. The arm 22 is attached to the robot base 20. The arm 22 has a plurality of joints and a plurality of links. The hand 24 is attached to the distal end of the arm 22. The hand 24 will be described in [11] below. The operation of the robot 12 is controlled by the controller 14.

[3. Controller 14]

The controller 14 is a computer including an input device, an arithmetic device, and a storage device (none of which are shown). The input device is a man-machine interface. For example, the arithmetic device is a processor. For example, the storage device is a memory such as a RAM and a ROM. The controller 14 stores the operation of the robot 12 by teaching performed in advance. The operation of the robot 12 includes a mounting operation of mounting the insert (cover member 72) in the casting mold 40. The controller 14 causes the robot 12 to reproduce various operations in accordance with predetermined operations performed by a user using the input device (not shown).

[4. Casting Machine 16]

The casting machine 16 includes a casting base 26, a fixed platen 28, a movable platen 30, a cylinder support 32, a cylinder 34, and the casting mold 40. The casting mold 40 has a fixed mold 42 and a movable mold 44. On the casting base 26, for example, the fixed platen 28, the movable platen 30, and the cylinder support 32 are arranged in this order from the −X direction toward the +X direction. The fixed platen 28 is fixed to the casting base 26. The movable platen 30 is movable in the −X direction and the +X direction along a guide (not shown) provided in the casting base 26. The casting mold 40 is disposed between the fixed platen 28 and the movable platen 30. The fixed mold 42 is attachable to and detachable from the surface of the fixed platen 28 facing in the +X direction. The movable mold 44 is attachable to and detachable from the surface of the movable platen 30 facing in the −X direction. The cylinder support 32 is fixed to the casting base 26. A cylinder tube 36 of the cylinder 34 is fixed to the surface of the cylinder support 32 facing in the +X direction. The cylinder support 32 has formed therein a hole (not shown) penetrating therethrough along the X direction. A piston rod 38 is inserted through the hole. An end portion of the piston rod 38 in the −X direction is fixed to the surface of the movable platen 30 facing in the +X direction. An end portion (not shown) of the piston rod 38 in the +X direction is fixed to a piston (not shown). The piston is slidable in the cylinder tube 36 along the X direction.

When fluid is supplied to a first fluid chamber (not shown) of the cylinder tube 36, the piston is pushed in the −X direction. Then, the piston rod 38 and the movable platen 30 move in the −X direction to close the casting mold 40. When fluid is supplied to a second fluid chamber (not shown) of the cylinder tube 36, the piston is pushed in the +X direction. Then, the piston rod 38 and the movable platen 30 move in the +X direction to open the casting mold 40.

[5. Casting Mold 40]

Figure 2:
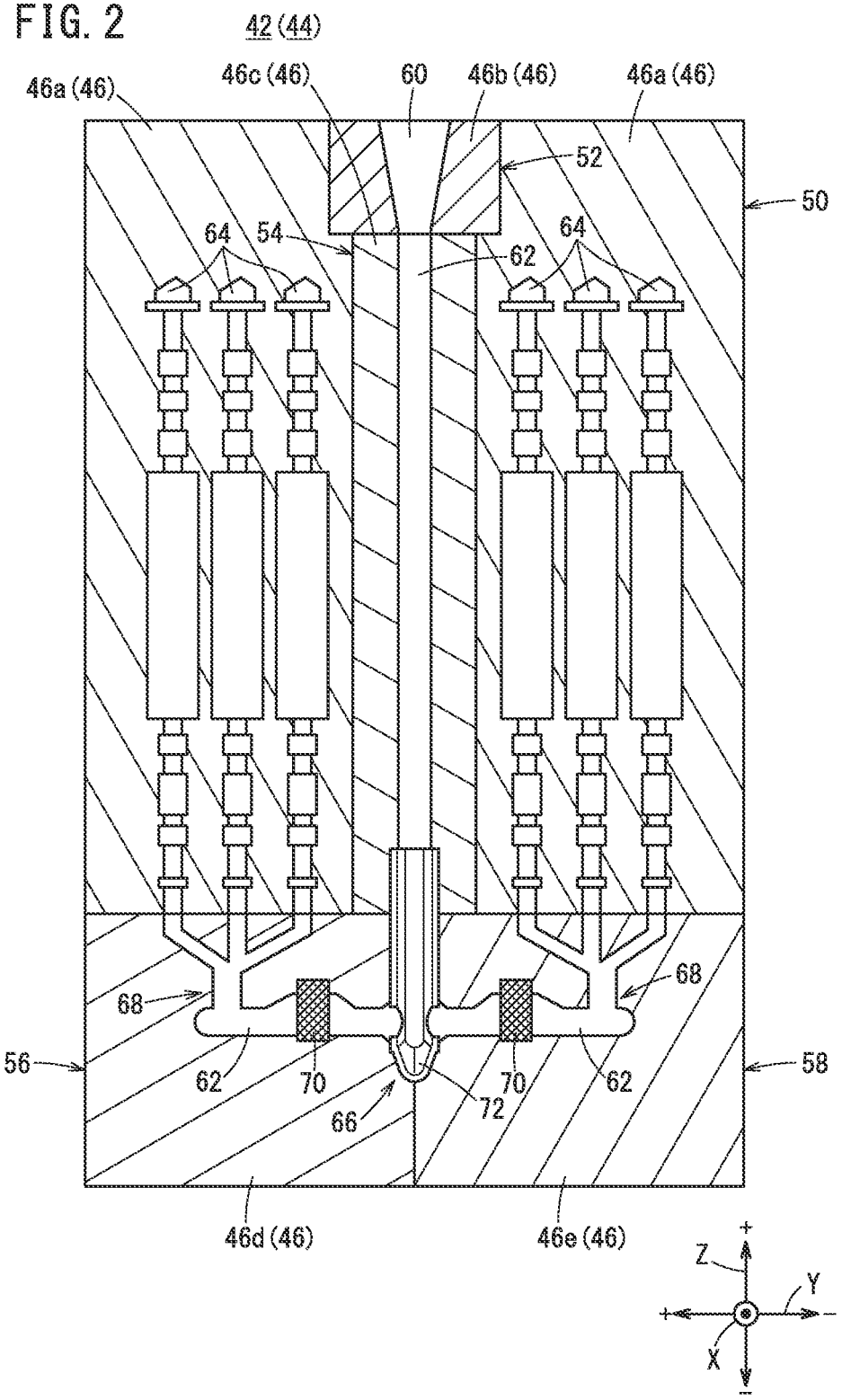
FIG. 2 is a view showing a fixed mold (movable mold) viewed from a separation surface side.

The casting mold 40 will be described with reference to FIG. 2. As described above, the casting mold 40 includes the fixed mold 42 and the movable mold 44. In a state where the casting mold 40 is closed, the fixed mold 42 and the movable mold 44 are symmetrical with respect to a mold mating surface (separation surface 46). Therefore, the fixed mold 42 will be described below, and the description of the movable mold 44 will be omitted. When the following description is read as the description of the movable mold 44, the +Y direction and the −Y direction in FIG. 2 are reversed.

The fixed mold 42 includes a first mold 50, a second mold 52, a third mold 54, a fourth mold 56, and a fifth mold 58. Each mold is made of, for example, copper. The first mold 50 is a main body (mold main body) of the fixed mold 42. The first mold 50 has a first separation surface 46*a*. The first separation surface 46*a* is a part of the separation surface 46. The first mold 50 further includes an attachment surface (not shown) recessed in the −X direction from the first separation surface 46*a*. The second mold 52 to the fifth mold 58 are components (partial molds) attached to the attachment surface (not shown) of the first mold 50 by bolts or the like. The second mold 52 has a second separation surface 46*b*. The third mold 54 has a third separation surface 46*c*. The fourth mold 56 has a fourth separation surface 46*d*. The fifth mold 58 has a fifth separation surface 46*e*. The second separation surface 46*b* to the fifth separation surface 46*e* are parts of the separation surface 46. In a state in which the second mold 52 to the fifth mold 58 are attached to the first mold 50, the first separation surface 46*a* to the fifth separation surface 46*e* are flush with each other. Thus, the separation surface 46 of the fixed mold 42 is formed by the first separation surface 46*a* to the fifth separation surface 46*e*.

The first mold 50 has two first separation surfaces 46*a*. One of the first separation surfaces 46*a* and the other of the first separation surfaces 46*a* are separated from each other in the +Y direction. The second mold 52 is positioned at the center of the upper portion of the fixed mold 42. The second separation surface 46*b* is located between one of the first separation surfaces 46*a* and the other of the first separation surfaces 46*a*. The second mold 52 has a lower surface facing in the −Z direction. The third mold 54 abuts against the lower surface of the second mold 52. The third separation surface 46*c* is located immediately below the second separation surface 46*b*. The third separation surface 46*c* is located between one of the first separation surfaces 46*a* and the other of the first separation surfaces 46*a*. The fourth mold 56 is positioned in the lower portion of the fixed mold 42. The fourth separation surface 46*d* is located immediately below one of the first separation surfaces 46*a*. The fourth separation surface 46*d* is located immediately below the third separation surface 46*c*. The fifth mold 58 is positioned in the lower portion of the fixed mold 42. The fifth separation surface 46*e* is located immediately below the other of the first separation surfaces 46*a*. The fifth separation surface 46*e* is located immediately below the third separation surface 46*c*. The position (height position) of the fourth mold 56 in the Z direction is the same as the position (height position) of the fifth mold 58 in the Z direction. The third mold 54, the fourth mold 56, and the fifth mold 58 form a passageway 62 described later. The third mold 54, the fourth mold 56, and the fifth mold 58 are arranged along the flow direction of the molten metal.

The fixed mold 42 includes a half of a pouring basin 60, a half of the passageway 62 (corresponding to a sprue, a runner, and a gate), and a half of a cavity 64. Each half is recessed in the −X direction from the separation surface 46. When the casting mold 40 is closed, the halves are mated together. As a result, the pouring basin 60, the passageway 62 and the cavity 64 are formed.

The pouring basin 60 is formed in the second mold 52. The pouring basin 60 opens in the +Z direction (upward direction). The pouring basin 60 has a tapered shape whose diameter decreases toward the −Z direction (downward direction).

The cavity 64 is formed in the first mold 50. Six cavities 64 are shown in FIG. 2. For example, a camshaft or balancer shaft of a vehicle is formed using the cavity 64. Three cavities 64 are formed in one of the first separation surfaces 46*a*. Three cavities 64 are also formed in the other of the first separation surfaces 46*a*.

The passageway 62 is formed across the third mold 54, the fourth mold 56, and the fifth mold 58. A first bent portion 66 and two second bent portions 68 are formed in the passageway 62. The first bent portion 66 and the two second bent portions 68 are located below the pouring basin 60 and the cavities 64. The passageway 62 extends downward (−Z direction) from the pouring basin 60 and branches in the lateral direction (±Y direction) at the first bent portion 66. The passageway 62 extends in the +Y direction from the first bent portion 66 and is bent upward (in the +Z direction) at the second bent portion 68 on the +Y direction side. The passageway 62 extends upward from the second bent portion 68 and branches into three. The three passageways 62 are directly connected to lower end portions of the three cavities 64 formed in one of the first separation surfaces 46*a*. Further, the passageway 62 extends in the −Y direction from the first bent portion 66 and is bent upward (in the +Z direction) at the second bent portion 68 on the −Y direction side. The passageway 62 extends upward from the second bent portion 68 and branches into three. The three passageways 62 are directly connected to lower end portions of the three cavities 64 formed in the other of the first separation surfaces 46*a*.

The molten metal supplied from the pouring basin 60 flows downward (−Z direction) in the passageway 62. The advancing direction of the molten metal is changed to the lateral direction (±Y direction) at the first bent portion 66. Further, the molten metal flows through the passageway 62 in the lateral direction (±Y direction) and passes through filters 70. The advancing direction of the molten metal is changed to the upward direction (+Z direction) at the second bent portions 68. The molten metal flows into each cavity 64 in the upward direction (+Z direction).

The passageway 62 is more likely to deteriorate than portions other than the passageway 62. In the present embodiment, when the passageway 62 deteriorates, the third mold 54 to the fifth mold 58 are replaced. Meanwhile, the first mold 50 and the second mold 52 are continuously used. Further, the passageway 62 is divided into three parts across the third mold 54 to the fifth mold 58 with the first bent portion 66 as the center. Therefore, the vertical stress and the lateral stress generated in the fixed mold 42 are reduced.

[6. Cover Member 72]

The cover member 72 is mounted inside the first bent portion 66. The cover member 72 is an insert. The cover member 72 covers the inner wall of the first bent portion 66 and the inner wall of the passageway 62 around the first bent portion 66. In addition, the cover member 72 allows the passageway 62 positioned on the upstream side of the first bent portion 66 to communicate with the passageway 62 positioned on the downstream side of the first bent portion 66. The cover member 72 is formed of a material having a lower thermal conductivity than the member of the fixed mold 42 (base material of the mold). For example, when an iron-based component is cast using the casting mold 40, the cover member 72 is made of an iron-based alloy such as a cold-rolled steel plate (SPCC). When both the cover member 72 and the molten metal are iron-based alloys, the cover member 72 may be re-melted and reused together with the casting design parts (the third mold 54, the fourth mold 56, and the fifth mold 58) separated from the product part (the first mold 50) after casting.

Figures 3A, 3B, 3C:
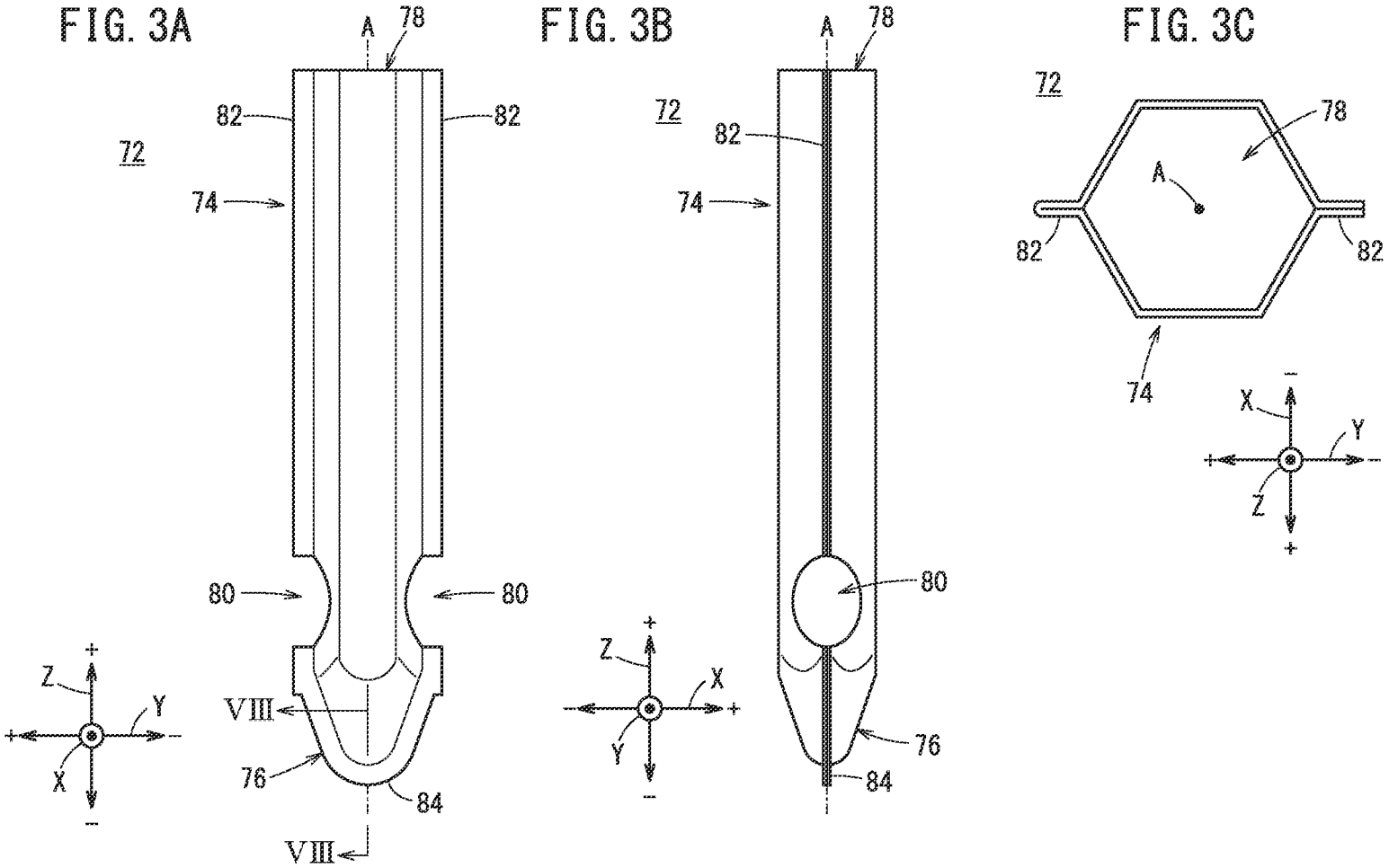
FIGS. 3A, 3B and 3C are views respectively showing a front surface, a left side surface, and a plane of a cover member.

The cover member 72 will be described with reference to FIGS. 3A to 3C. The cover member 72 is formed of a single steel plate. The steel plate is subjected to shearing, drawing, and bending. The first end of the steel plate and the second end of the steel plate are joined to each other. Thus, the steel plate is formed into a bottomed cylindrical shape having an axis A. As shown in FIG. 3C, the outer peripheral shape of the cover member 72 viewed from the +Z direction is a substantially regular hexagonal shape when side wall flanges 82 described later are ignored.

The cover member 72 has a body portion 74 and a bottom portion 76. The body portion 74 has a tubular shape. The axis A of the body portion 74 extends in the up-down direction (Z direction). The bottom portion 76 extends downward from the lower end of the body portion 74. The cross-sectional area of the bottom portion 76 in the XY plane decreases in the downward direction. An upper hole 78 is formed in an upper end of the body portion 74. The upper hole 78 opens upward. Two lateral holes 80 are formed in the side wall of the body portion 74 above the bottom portion 76. The two lateral holes 80 open in the lateral direction (+Y direction and −Y direction). The upper hole 78 is an inlet of a flow path formed in the cover member 72. The two lateral holes 80 are outlets of the flow path formed in the cover member 72. The upper hole 78 is directly connected to the passageway 62 (the passageway 62 of the third mold 54) positioned on the upstream side of the cover member 72. One of the lateral holes 80 is directly connected to the passageway 62 (the passageway 62 of the fourth mold 56) positioned on the downstream side of the cover member 72. The other of the lateral holes 80 is directly connected to the passageway 62 (the passageway 62 of the fifth mold 58) positioned on the downstream side of the cover member 72. The inner diameter of the upper hole 78 (and the inner diameter of the flow path formed in the cover member 72) are equal to or larger than the inner diameter of the passageway 62 (the passageway 62 of the third mold 54) positioned on the upstream side of the cover member 72. Each inner diameter is preferably the same.

The cover member 72 has a flange. Specifically, the body portion 74 of the cover member 72 has the side wall flange 82 on each of the side walls on both sides in the Y direction. Each side wall flange 82 extends in the up-down direction (Z direction) from the upper hole 78 to the lateral hole 80. Each side wall flange 82 projects outwardly from the outer wall of the cover member 72. Each sidewall flange 82 is parallel to the YZ plane. One of the sidewall flanges 82 is shifted 180 degrees about the axis A relative to the other of the sidewall flanges 82. A bottom flange 84 is formed on the outer wall of the bottom portion 76. The bottom flange 84 extends from the two lateral holes 80 to the lower end of the bottom portion 76. The side wall flange 82 projecting in the +Y direction is a bent part formed by bending a substantially central portion of the steel plate. The side wall flange 82 projecting in the −Y direction is an abutment part formed by the first end of the steel plate and the second end of the steel plate abutting against each other. At the abutment part, the first end of the steel plate and the second end of the steel plate are joined to each other. On the other hand, the bottom flange 84 includes a bent part and an abutment part.

[7. Cover Housing Portion 90]

Figure 4:
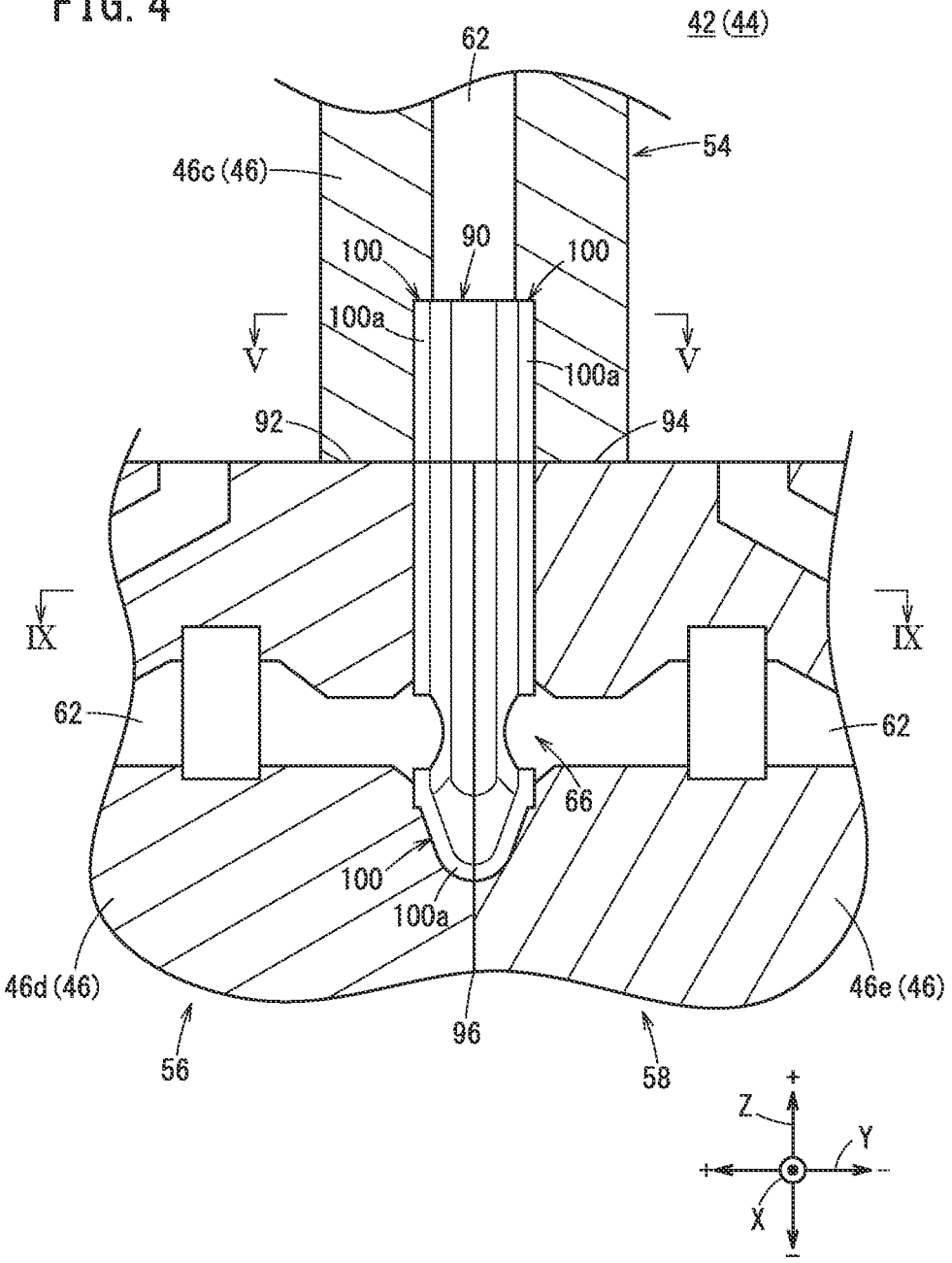
FIG. 4 is a view showing a cover housing portion and its peripheral structure viewed from the separation surface side.

The cover housing portion 90 will be described with reference to FIGS. 4 and 5. FIG. 4 shows a part of the fixed mold 42 in which the cover member 72 and the filters 70 shown in FIG. 2 are not mounted. In the passageway 62, the cover housing portion 90 is formed from the first bent portion 66 over a predetermined range on the upstream side thereof (in the +Z direction). The cover housing portion 90 houses the cover member 72 (FIG. 2). The cover housing portion 90 is more widely recessed than the passageway 62 adjacent to the cover housing portion 90. The inner diameter of the cover housing portion 90 is larger than the inner diameter of the passageway 62 positioned on the upstream side of the cover housing portion 90.

The cover housing portion 90 is formed across the third mold 54, the fourth mold 56, and the fifth mold 58. Therefore, the cover housing portion 90 includes abutment portions where two molds abut against each other. Specifically, the cover housing portion 90 includes a first abutment portion 92, a second abutment portion 94, and a third abutment portion 96. At the first abutment portion 92, the third mold 54 and the fourth mold 56 abut against each other. At the second abutment portion 94, the third mold 54 and the fifth mold 58 abut against each other. At the third abutment portion 96, the fourth mold 56 and the fifth mold 58 abut against each other.

Flange housing grooves 100 are formed in an edge of the cover housing portion 90 adjacent to the separation surface 46 (the third separation surface 46*c*, the fourth separation surface 46*d*, and the fifth separation surface 46*e*). In the present embodiment, the flange housing groove 100 that houses the side wall flange 82 projecting in the +Y direction is formed across the third mold 54 and the fourth mold 56. The flange housing groove 100 that houses the side wall flange 82 projecting in the −Y direction is formed across the third mold 54 and the fifth mold 58. The flange housing groove 100 that houses the bottom flange 84 is formed across the fourth mold 56 and the fifth mold 58.

Figure 5:
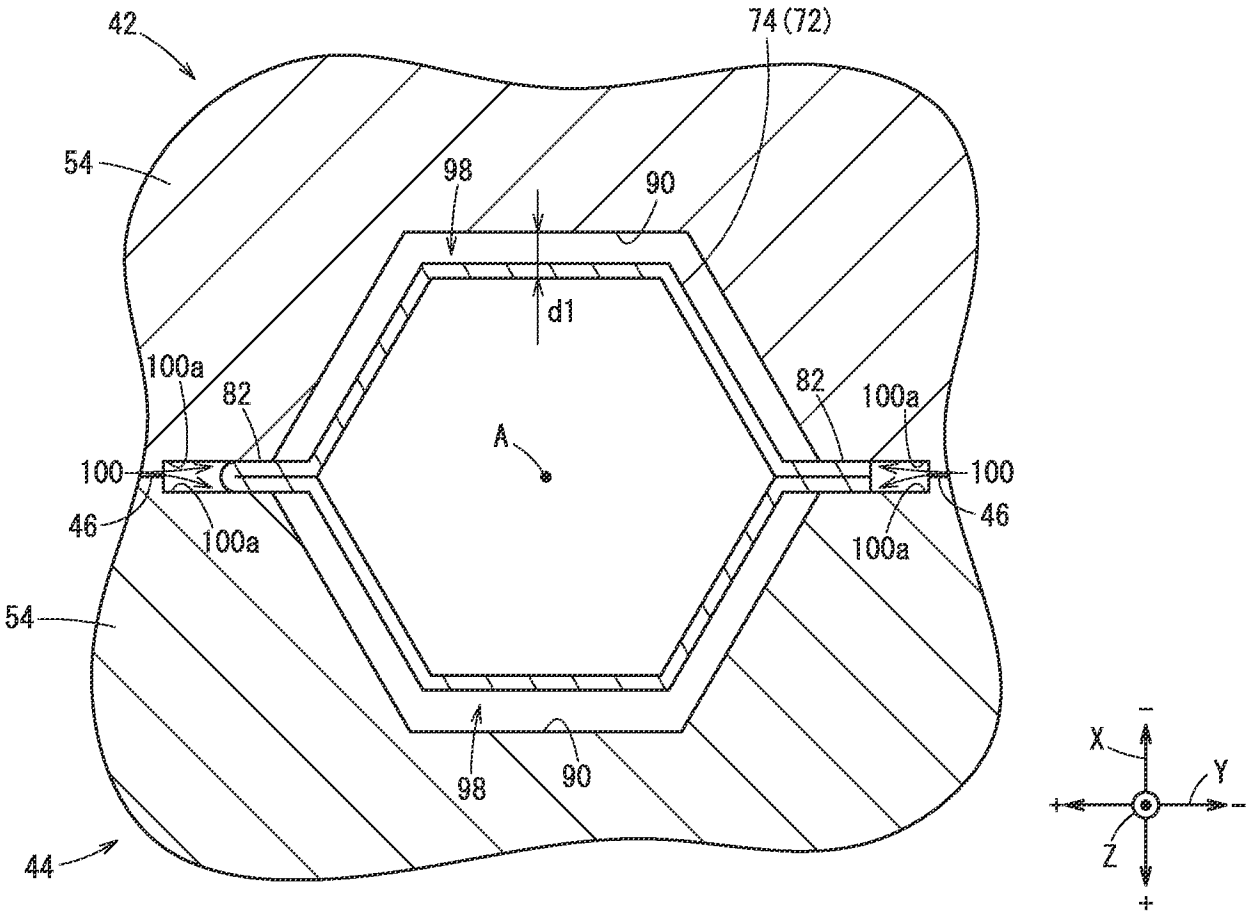
FIG. 5 is a cross-sectional view of the periphery of the cover member of a closed mold taken along line V-V (XY plane) in FIG. 4.

As shown in FIG. 5, the inner peripheral shape of the cover housing portion 90 is similar to the outer peripheral shape of the cover member 72. In the case of the present embodiment, the inner peripheral shape of the cover housing portion 90 is a substantially regular hexagonal shape when the flange housing grooves 100 are ignored. The size of the cover housing portion 90 is larger than the size of the thermally expanded cover member 72. This prevents the thermally expanded cover member 72 from becoming larger than the cover housing portion 90. Further, at low temperature, a gap 98 is formed between the outer wall of the cover member 72 and the inner wall of the cover housing portion 90.

When the casting mold 40 is closed after the cover member 72 is mounted in the cover housing portion 90, the side wall flanges 82 and the bottom flange 84 are housed in the flange housing grooves 100. It is preferable that the side wall flanges 82 abut against a bottom surface 100*a* of the flange housing groove 100 of the fixed mold 42 and a bottom surface 100*a* of the flange housing groove 100 of the movable mold 44.

[8. Gap 98 between Cover Member 72 and Cover Housing Portion 90]

A width d1 of the gap 98 will be described with reference to FIGS. 5 to 7. When the gap 98 is formed, an air layer is formed around the cover member 72. That is, the gap 98 has a heat insulating function. However, if the width d1 of the gap 98 is too large, the molten metal may enter the gap 98. In the worst case, the molten metal enters the abutment portions (the first abutment portion 92, the second abutment portion 94, and the third abutment portion 96). In this case, the following problems occur.

When the molten metal is cooled and solidified, the metal product formed in the cavity 64, the residual metal remaining in the passageway 62, and the cover member 72 are integrated. Therefore, when the metal product is released from the mold, the residual metal and the cover member 72 are taken out from the mold together with the metal product. When the molten metal enters the abutment portions, burrs are generated around the cover member 72. This makes it difficult to release the metal product from the mold. If the metal product is pushed by a pushing pin or the like in order to release the metal product from the mold, the metal product may be damaged or deformed. In order to prevent such a problem, the gap 98 is required to have a function of preventing the entry of the molten metal.

Therefore, the present inventors studied an appropriate width d1 of the gap 98. In the study, the inventors measured the amount of molten metal leaking from the upper end of the cover member 72 to the gap 98. Specifically, the inventors measured the molten metal leakage length extending downward (in the −Z direction) from the upper end of the cover member 72. Further, the inventors set the threshold value of the allowable molten metal leakage length to 60 [mm]. FIG. 6 shows the measurement results. Concerning the width d1 shown in FIG. 6, the third decimal place is rounded off.

Figure 6:
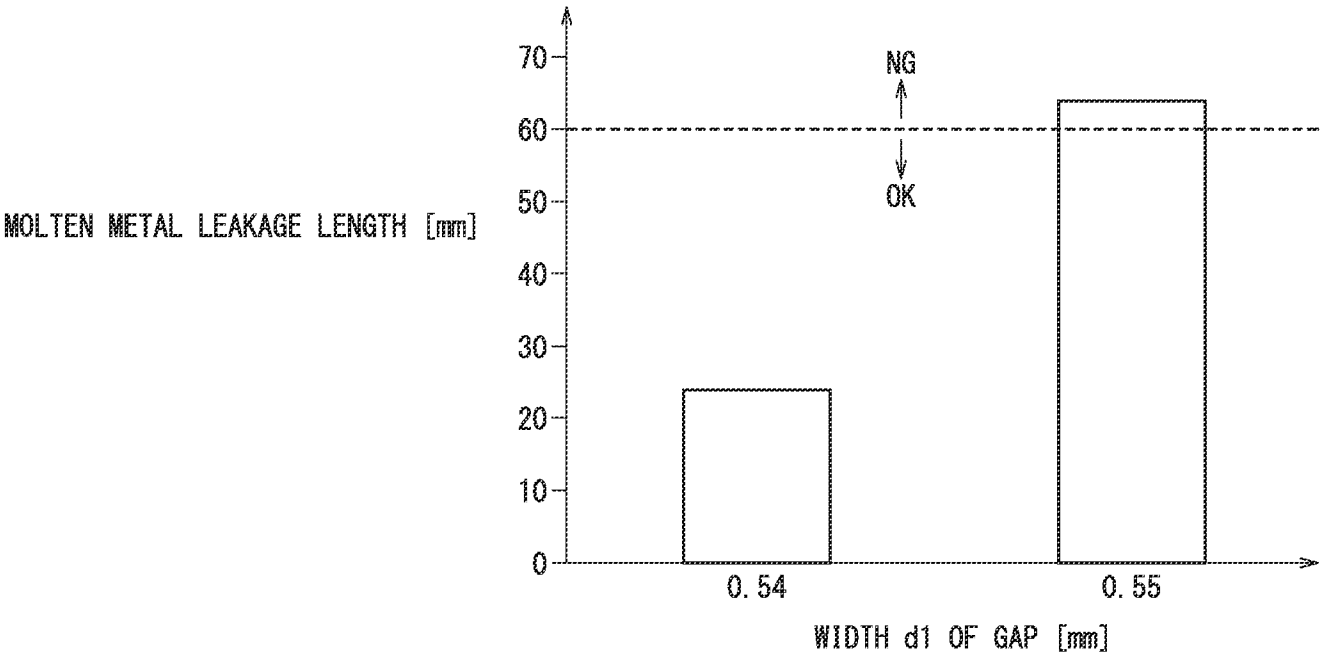
FIG. 6 is a graph showing the relationship between the width of a gap and the molten metal leakage length.

As shown in FIG. 6, when the width d1 of the gap 98 at low temperature is 0.54 [mm] or less, the molten metal leakage length becomes smaller than the threshold value. When the width d1 of the gap 98 at low temperature is 0.55 [mm] or more, the molten metal leakage length becomes larger than the threshold value. From this measurement result, it is understood that, when the width d1 of the gap 98 at low temperature is 0.54 [mm] or less, it is acceptable even if the molten metal enters the gap 98. Further, when the width d1 of the gap 98 at low temperature is larger than 0 [mm], an air layer is formed around the cover member 72. Therefore, a heat insulating effect can be expected. However, even if the width d1 is 0 [mm], since the cover member 72 is formed of a material having low thermal conductivity as described above, heat insulating effect can be expected to a certain degree. From the above study, the inventors have reached the following conclusion. By setting the width d1 of the gap 98 at low temperature to 0 [mm] or more and 0.54 [mm] or less, both the heat insulating function and the function of preventing the entry of the molten metal can be achieved. The inventors have confirmed that this numerical range is applicable to a plurality of casting molds 40 having different structures and sizes.

Figure 7:
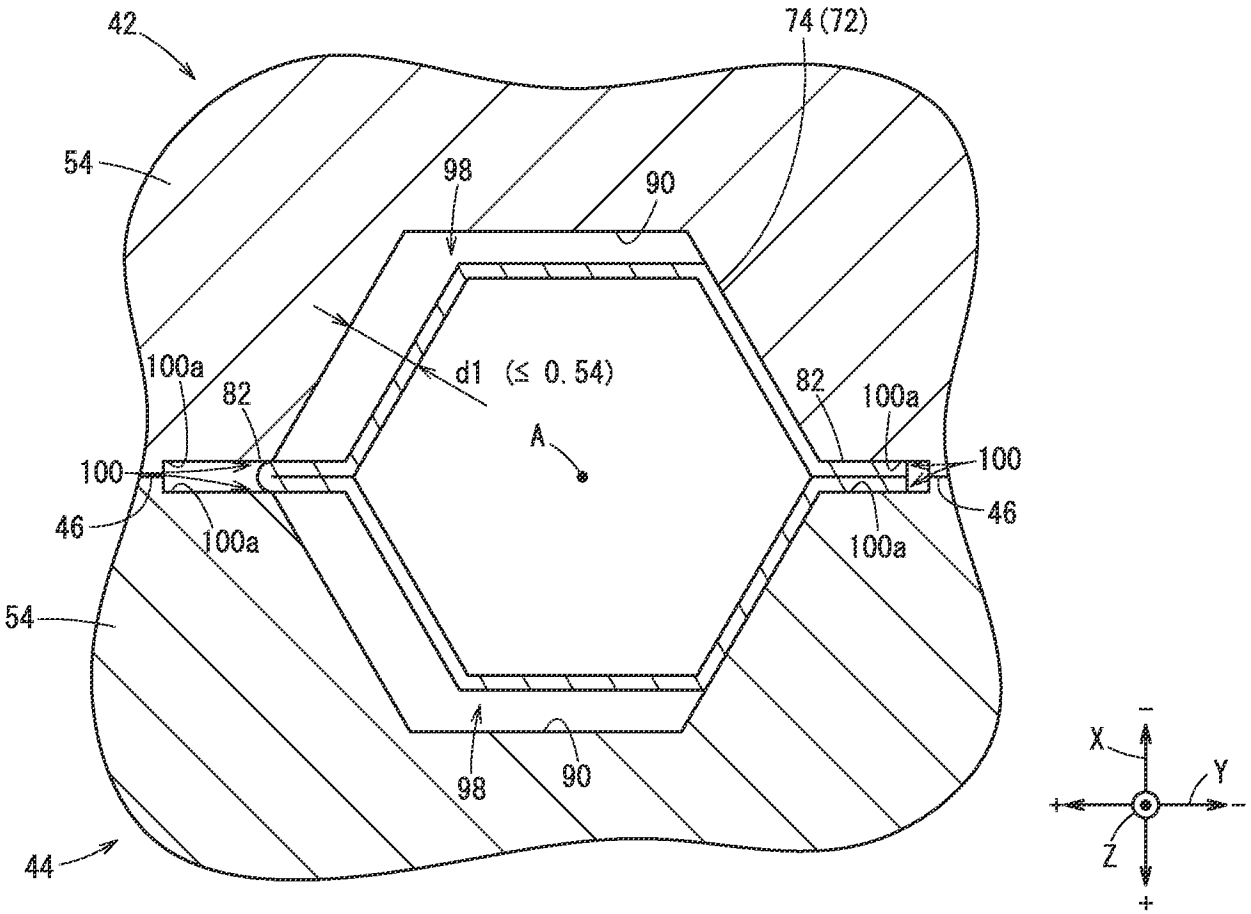
FIG. 7 is a view showing a state in which the cover member is displaced in the cross section shown in FIG. 5.

As shown in FIG. 7, there is a possibility that the cover member 72 is displaced in the Y direction in the cover housing portion 90. In the present embodiment, the outer peripheral shape of the cover member 72 and the inner peripheral shape of the cover housing portion 90 are substantially regular hexagonal shapes. In this case, in order to set the width d1 of the gap 98 to 0.54 [mm] or less over the entire range, it is necessary to consider the deviation in the Y direction. As shown in FIG. 7, it is preferable to design the sizes of the cover member 72 and the cover housing portion 90 so that the width d1 of the gap 98 which becomes widest in a state where the cover member 72 is maximally displaced in the −Y direction (or the +Y direction) is 0.54 [mm] or less.

[9. Flange Gap 102]

Figure 8:
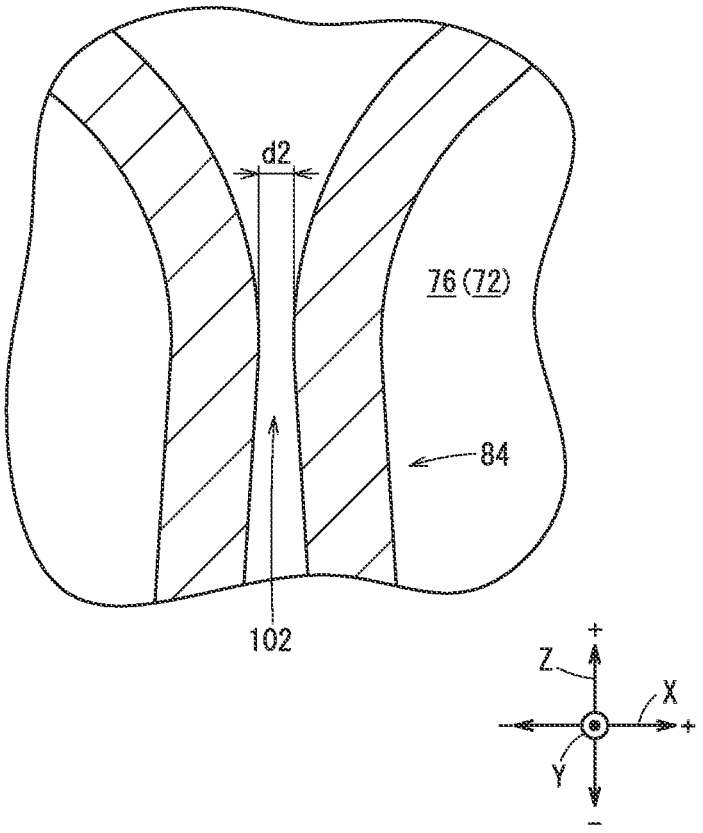
FIG. 8 is a cross-sectional view of the bottom portion of the cover member taken along line VIII-VIII (XY plane) in FIG. 3A.

As shown in FIG. 8, a gap 102 is formed between the first end of the steel plate and the second end of the steel plate at the distal end of the bottom flange 84. If a width d2 of the gap 102 is too large, there is a possibility that the leakage of the molten metal from the bottom flange 84 exceeds an allowable level. Therefore, the gap 102 also has an appropriate width d2.

In order to determine an appropriate width d2 of the gap 102, the inventors confirmed the condition of the molten metal leakage for each width d2 of the gap 102. As a result, the inventors reached the following conclusion. When the width d2 of the gap 102 at low temperature is 0.3 [mm] or less, the leakage of the molten metal from the bottom flange 84 can be prevented. This conclusion also applies to the sidewall flange 82.

[10. Magnet 104 for Attracting Cover Member 72]

Figure 9:
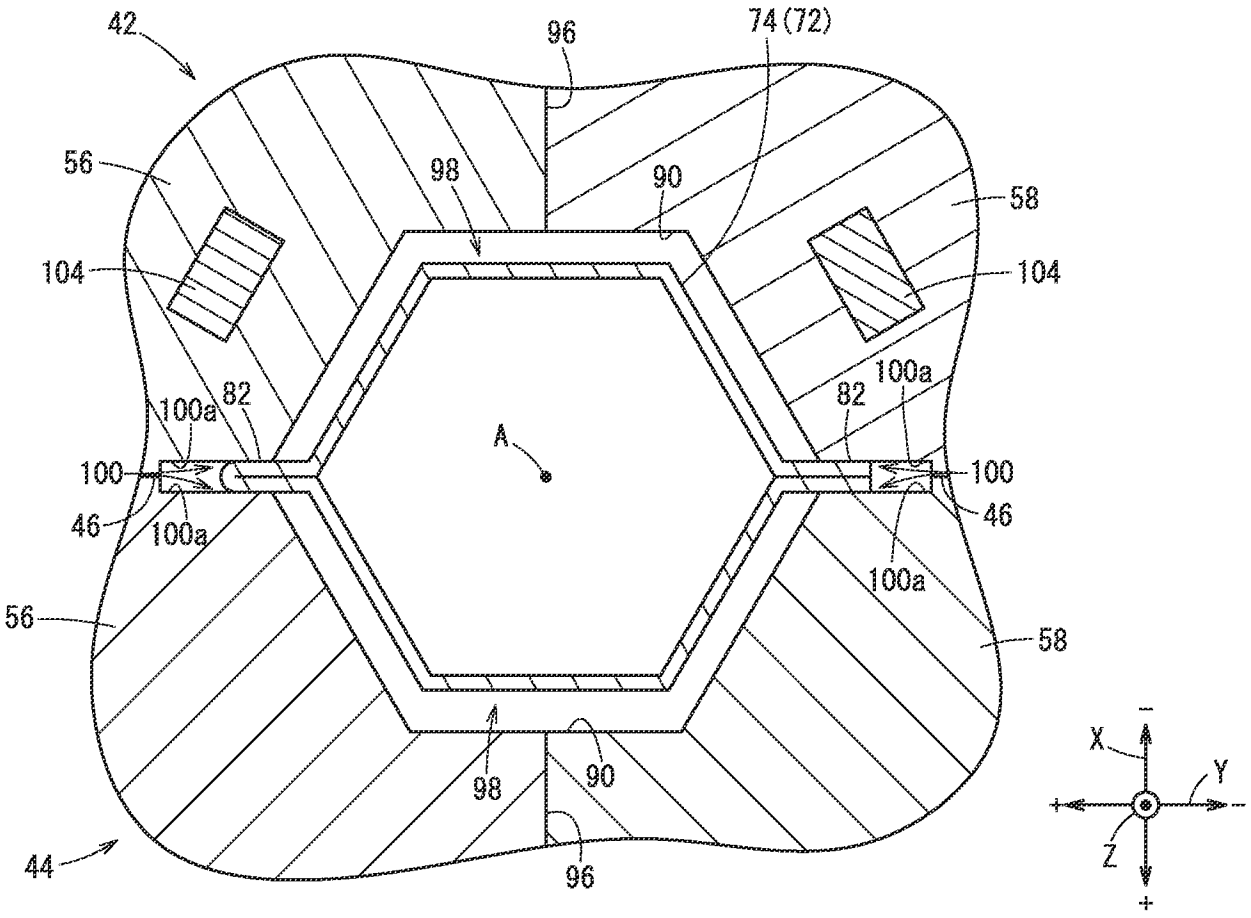
FIG. 9 is a cross-sectional view of the periphery of the cover member of the closed mold taken along line IX-IX (XY plane) in FIG. 4.
Figure 10:
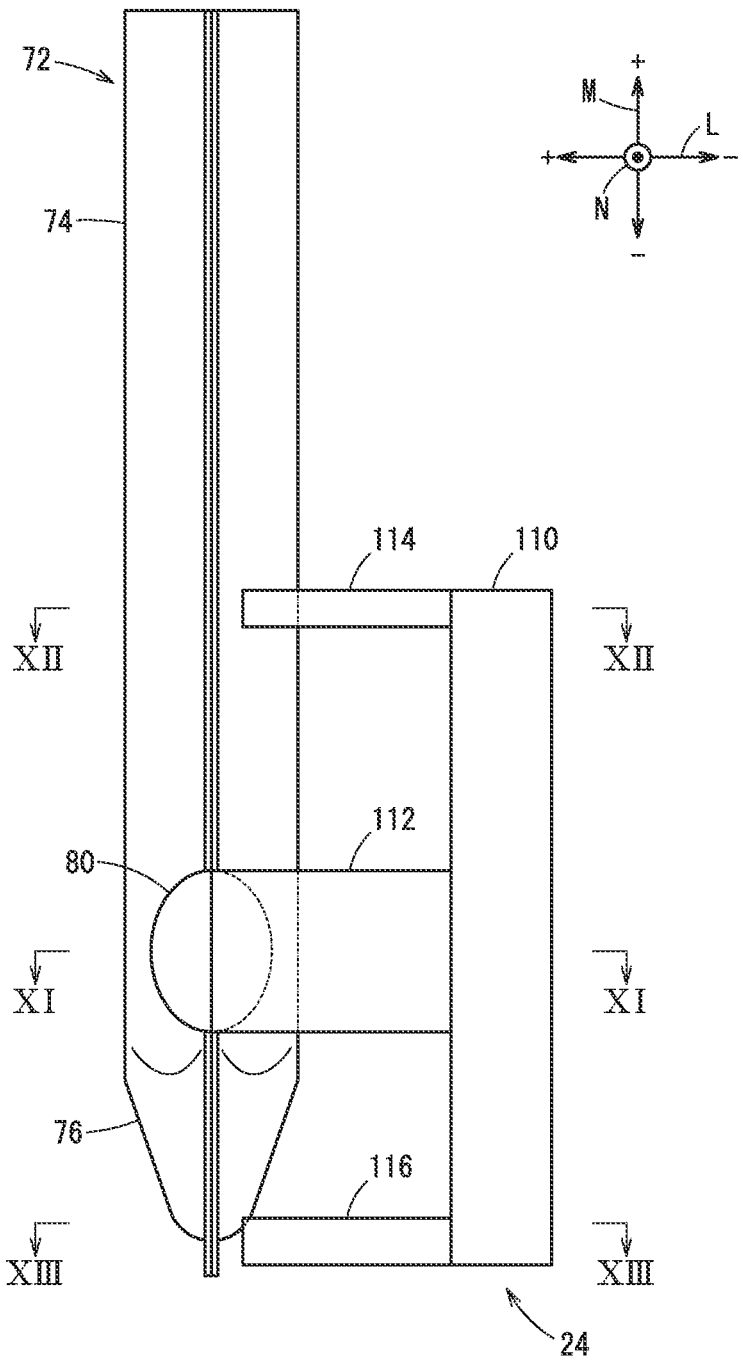
FIG. 10 is a view showing the cover member and a hand.

As shown in FIG. 9, a heat-resistant magnet 104 is embedded in the cover housing portion 90 of one of the fixed mold 42 and the movable mold 44. The magnet 104 attracts the cover member 72. In the present embodiment, the magnet 104 is embedded in each of the fourth mold 56 of the fixed mold 42 and the fifth mold 58 of the fixed mold 42. The magnet 104 of the fourth mold 56 and the magnet 104 of the fifth mold 58 are provided at symmetrical positions with respect to the XZ plane passing through the axis A. In a case where the fixed mold 42 is not divided into the fourth mold 56 and the fifth mold 58 but is integrally formed, one magnet 104 may be provided.

[11. Hand 24 of Robot 12]

The hand 24 provided in the robot 12 (FIG. 1) will be described with reference to FIGS. 10 to 13. In the following description, directions such as an L direction, an M direction, and an N direction are used. The L direction and the M direction are orthogonal to each other. The N direction is orthogonal to the L direction and the M direction. The forward direction of each direction is defined as +, and the reverse direction thereof is defined as −.

The hand 24 can grip the cover member 72 at a predetermined position of the equipment. The hand 24 includes a hand body 110, a pair of movable portions 112, an upper holding portion 114, and a lower holding portion 116.

The hand body 110 is attached to the distal end portion of the arm 22 (FIG. 1). The hand body 110 supports the pair of movable portions 112, the upper holding portion 114, and the lower holding portion 116. The pair of movable portions 112, the upper holding portion 114, and the lower holding portion 116 project from the hand body 110 in the +L direction. The upper holding portion 114 is positioned on the downstream side of the pair of movable portions 112 in the +M direction. The lower holding portion 116 is positioned on the downstream side of the pair of movable portions 112 in the −M direction.

Figure 11:
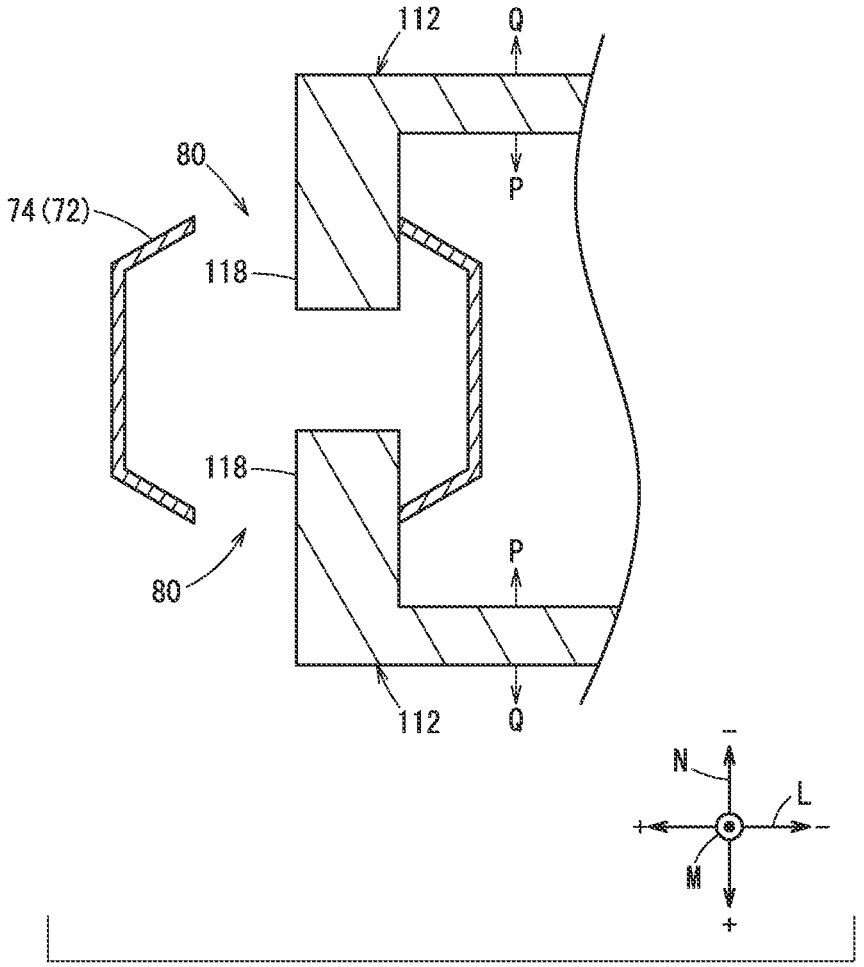
FIG. 11 is a cross-sectional view of the cover member and the hand taken along line XI-XI in FIG. 10.

As shown in FIG. 11, the first movable portion 112 is arranged on the downstream side of the second movable portion 112 in the +N direction. A holding claw 118 is formed at the tip of each movable portion 112 in the +L direction. The first movable portion 112 and the second movable portion 112 can approach each other. Arrows P shown in FIG. 11 indicate directions in which the first movable portion 112 and the second movable portion 112 approach each other. The first movable portion 112 and the second movable portion 112 can move away from each other. Arrows Q shown in FIG. 11 indicate directions in which the first movable portion 112 and the second movable portion 112 move away from each other. The holding claw 118 of the first movable portion 112 and the holding claw 118 of the second movable portion 112 protrude toward each other. The pair of movable portions 112 can move in the ±N directions according to the operation of a motor or the like. The pair of movable portions 112 operate in directions (arrows P) approaching each other. Further, the pair of movable portions 112 grip the cover member 72 by inserting the holding claws 118 into the lateral holes 80 of the cover member 72. Further, the pair of movable portions 112 operate in directions (arrows Q) away from each other. Further, the pair of movable portions 112 release the cover member 72 by pulling out the holding claws 118 from the lateral holes 80 of the cover member 72.

When the cover member 72 is attached to the cover housing portion 90, the cover member 72 is moved in the −X direction to approach the cover housing portion 90. At this time, each of the holding claws 118 inserted into the lateral holes 80 is positioned in front of the passageway 62. Therefore, even if the cover member 72 is brought close to the cover housing portion 90, there is a low possibility that each of the holding claws 118 comes into contact with the separation surface 46. Thus, according to the present embodiment, the cover member 72 can be brought further closer to the inner wall of the cover housing portion 90. Further, according to the present embodiment, there is a low possibility that the holding claw 118 comes into contact with the separation surface 46 after the cover member 72 is attached to the cover housing portion 90.

Figure 12:
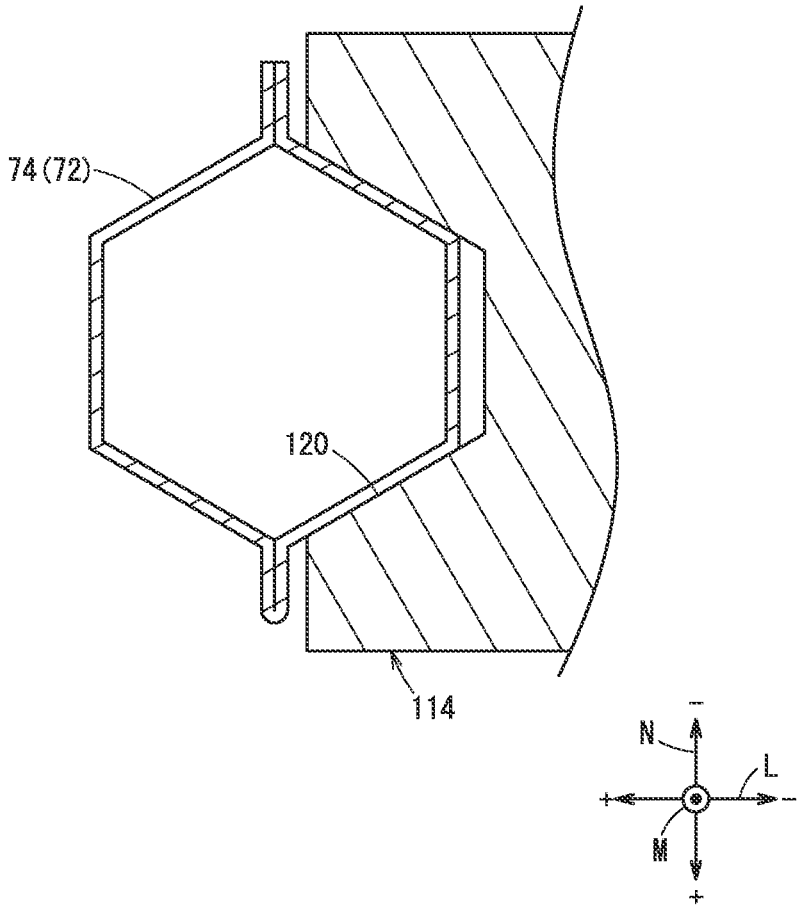
FIG. 12 is a cross-sectional view of the cover member and the hand taken along line XII-XII of FIG. 10.

As shown in FIG. 12, an upper abutment portion 120 is formed at the tip of the upper holding portion 114 in the +L direction. The upper abutment portion 120 abuts against the body portion 74 of the cover member 72. With this structure, when the pair of movable portions 112 grip the cover member 72, the cover member 72 is prevented from wobbling.

Figure 13:
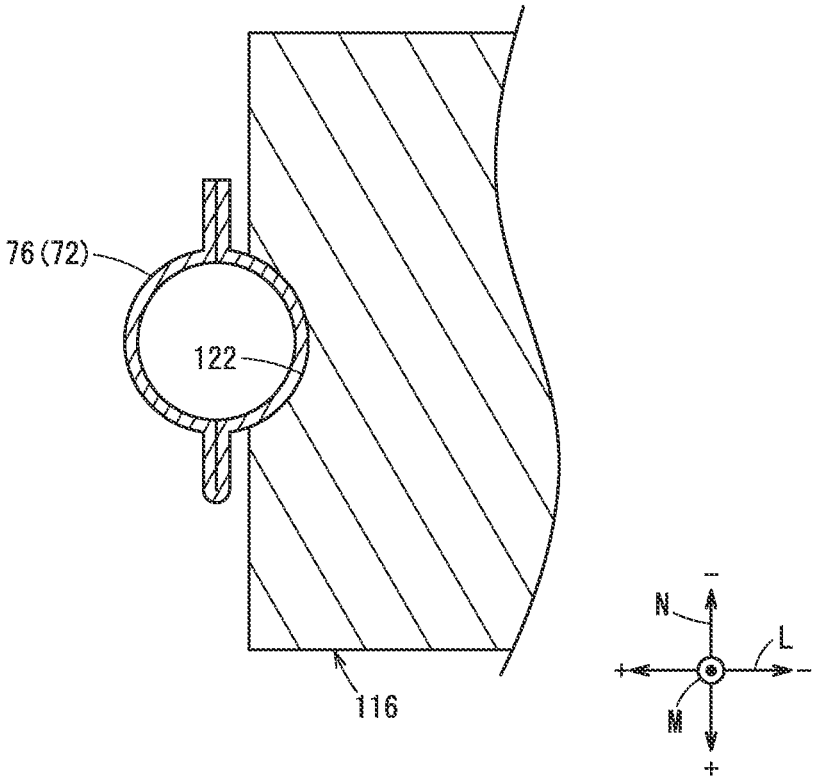
FIG. 13 is a cross-sectional view of the cover member and the hand taken along line XIII-XIII in FIG. 10.

As shown in FIG. 13, a lower abutment portion 122 is formed at the tip of the lower holding portion 116 in the +L direction. In the LN plane, the shape of the lower abutment portion 122 coincides with a part of the outer peripheral shape of the bottom portion 76 of the cover member 72. Similarly to the bottom portion 76 of the cover member 72, the diameter of the lower abutment portion 122 decreases from the upper side (+M direction) toward the lower side (−M direction). The lower abutment portion 122 abuts against the bottom portion 76 of the cover member 72. The lower abutment portion 122 prevents the cover member 72 from wobbling when the pair of movable portions 112 grip the cover member 72. Further, the lower abutment portion 122 prevents the cover member 72 from displacing downward when the pair of movable portions 112 grip the cover member 72.

[12. Operation of Mounting Cover Member 72 in Cover Housing Portion 90]

Figure 14:
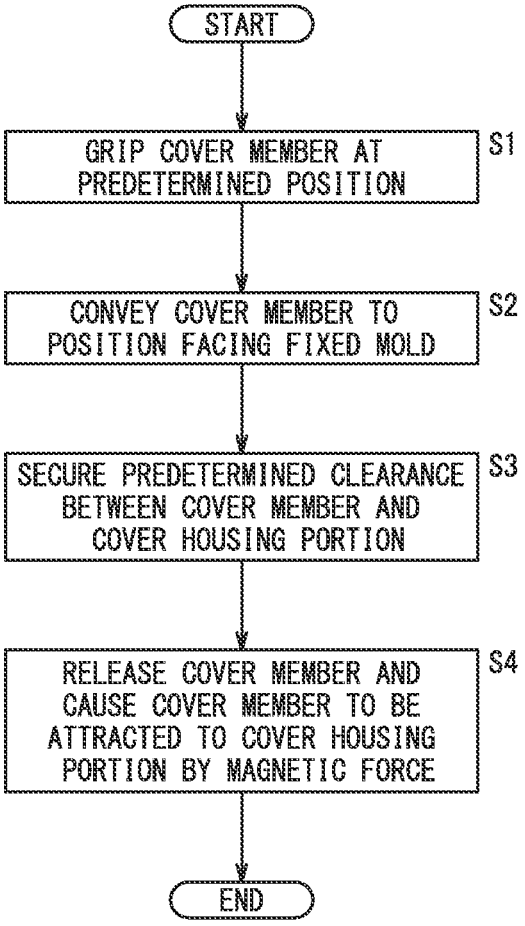
FIG. 14 is a flowchart of a series of operations for mounting the cover member to the cover housing portion.

A series of operation procedures in which the robot 12 mounts the cover member 72 in the cover housing portion 90 of the fixed mold 42 will be described with reference to FIG. 14. The controller 14 controls the operation of the robot 12 to perform the following series of operations.

In step S1, the robot 12 moves the hand 24 to a predetermined position in which the cover member 72 is supplied, and grips the cover member 72 with the hand 24. At this time, the robot 12 operates the pair of movable portions 112 in the directions as indicated by the arrows P in FIG. 11 to insert the holding claws 118 into the lateral holes 80 of the cover member 72.

In step S2, the robot 12 conveys the cover member 72 to a position facing the fixed mold 42 while gripping the cover member 72 with the hand 24. The separation surface 46 of the fixed mold 42 is parallel to the up-down direction (Z direction). The robot 12 brings the cover member 72 close to the cover housing portion 90. At this time, the robot 12 directs the upper hole 78 of the cover member 72 upward (in the +Z direction). Further, the robot 12 makes the axis A of the cover member 72 parallel to the up-down direction (Z direction).

In step S3, the robot 12 positions the cover member 72 with respect to the cover housing portion 90. At this time, the robot 12 secures a predetermined clearance between the cover member 72 and the cover housing portion 90. The robot 12 may perform positioning based on a detection value of a sensor that detects a distance between the cover member 72 and the cover housing portion 90. Further, the robot 12 may perform positioning using a camera.

In step S4, the robot 12 releases the cover member 72 and causes the cover member 72 to be attracted to the cover housing portion 90 by the magnetic force of the magnets 104. At this time, the robot 12 operates the pair of movable portions 112 in the directions as indicated by the arrows Q in FIG. 11 to pull out the holding claws 118 from the lateral holes 80 of the cover member 72. Since the predetermined clearance is secured between the cover member 72 and the cover housing portion 90, the cover member 72 is attracted to the cover housing portion 90 without falling.

The robot 12 mounts the filters 70 in the fixed mold 42 before or after mounting the cover member 72 in the cover housing portion 90. After the robot 12 mounts the cover member 72 and the filters 70, the casting machine 16 closes the casting mold 40.

[13. Other Embodiments]

Figure 15C:
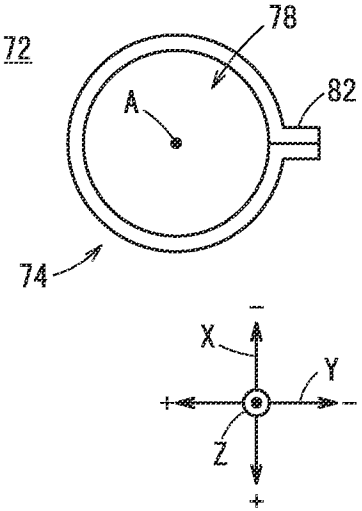
FIGS. 15A, 15B and 15C are views respectively showing a front surface, a left side surface, and a plane of a cover member having a different form from that of the cover member of FIGS. 3A, 3B and 3C.
Figure 15B:
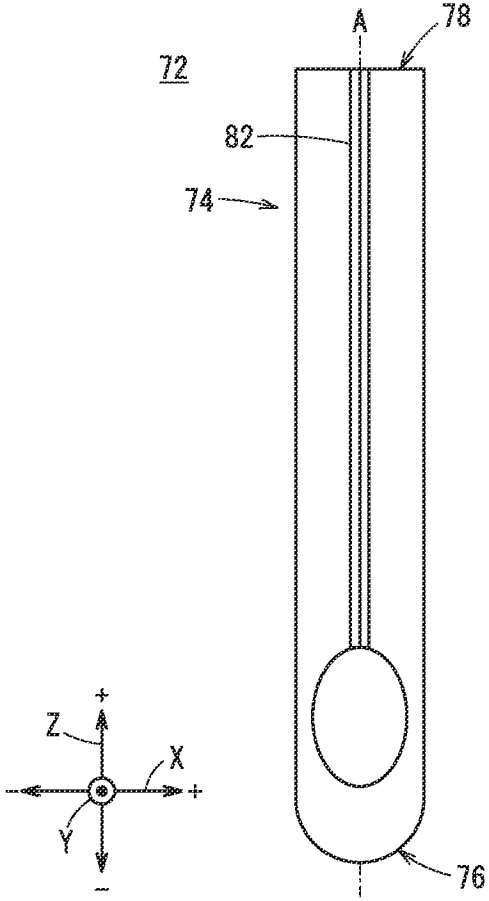
Figure 15A:
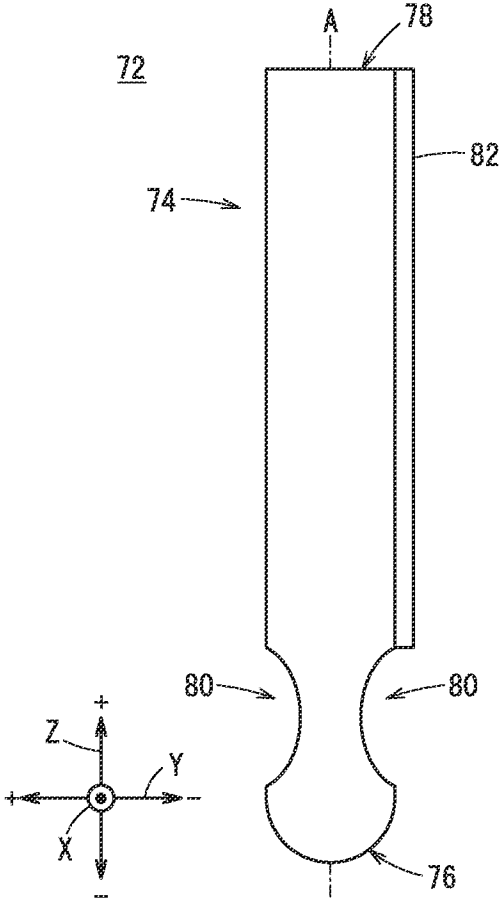

The outer peripheral shape of the cover member 72 may be a polygonal shape other than the substantially regular hexagonal shape. For example, as shown in FIGS. 15A to 15C, the outer peripheral shape of the cover member 72 may be circular. In the cover member 72 shown in FIGS. 15A to 15C, the same components as those of the cover member 72 shown in FIGS. 3A to 3C are denoted by the same reference numerals. The cover member 72 having a circular outer peripheral shape has a side wall flange 82 projecting in the −Y direction and corresponding to the abutment part. The bottom portion 76 is formed by drawing.

Figure 16:
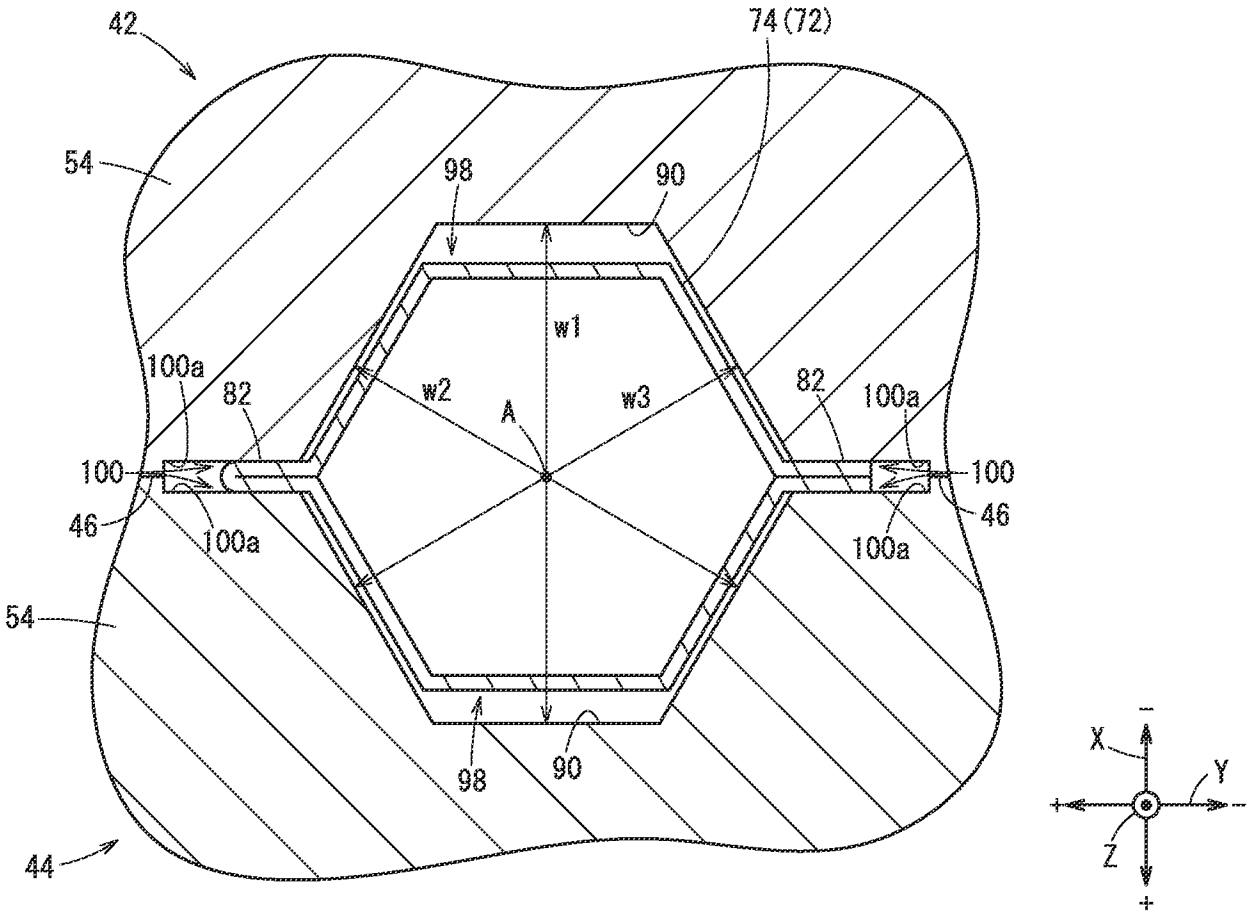
FIG. 16 is a cross-sectional view of another embodiment different from the embodiment shown in FIG. 5.

In the above embodiment, the inner peripheral shape of the cover housing portion 90 is similar to the outer peripheral shape of the cover member 72. Alternatively, the inner peripheral shape of the cover housing portion 90 and the outer peripheral shape of the cover member 72 may not be similar to each other. For example, as shown in FIG. 16, the outer peripheral shape of the cover member 72 may be a substantially regular hexagonal shape, and the inner peripheral shape of the cover housing portion 90 may be a hexagonal shape elongated in the X direction. In the embodiment shown in FIG. 16, a diameter w1 of the cover housing portion 90 is longer than a diameter w2 and a diameter w3 thereof.

Further, the outer peripheral shape of the cover member 72 may be another polygonal shape, and the inner peripheral shape of the cover housing portion 90 may be a polygonal shape elongated in the X direction.

Figure 17:
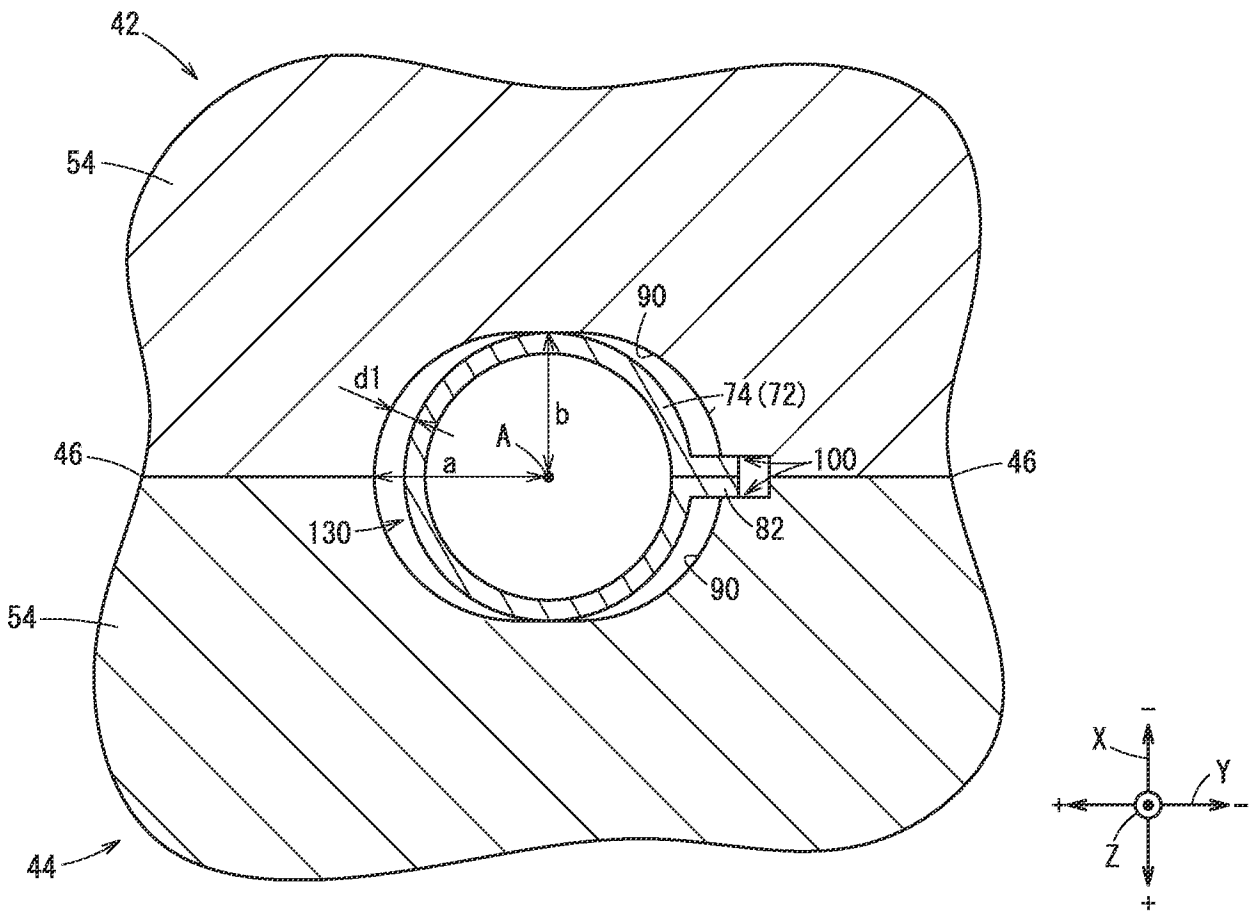
FIG. 17 is a cross-sectional view of another embodiment different from the embodiment shown in FIG. 5.

Further, as shown in FIG. 17, the outer peripheral shape of the cover member 72 may be substantially circular, and the inner peripheral shape of the cover housing portion 90 may be an oval (including an ellipse). A minor axis b of the ellipse may be orthogonal to the separation surface 46 (mold mating surface). A major axis a of the ellipse may be parallel to the separation surface 46 (mold mating surface). For example, a gap 130 is formed between the inner wall of the cover housing portion 90 and the outer wall of the cover member 72. The maximum value of a width d1 of the gap 130 is preferably 0 [mm] or more and 0.54 [mm] or less.

In the embodiment described above, the cover member 72 is mounted in the first bent portion 66. Not only the first bent portion 66 but also the second bent portion 68 may be mounted with the cover member 72 having a shape corresponding to the shape of the second bent portion 68.

In the above-described embodiment, the passageway 62 branches in the +Y direction and the −Y direction at the first bent portion 66. Alternatively, the passageway 62 may be bent only in one direction without branching.

In the above embodiment, the side wall flange 82 is formed by joining both ends of the steel plate. Alternatively, the side wall flange 82 may be formed by bringing both ends of the steel plate into close contact with each other. For example, both ends of the steel plate may be sandwiched between the bottom surface 100*a* of the flange housing groove 100 of the fixed mold 42 and the bottom surface 100*a* of the flange housing groove 100 of the movable mold 44 to be in close contact with each other.

In the above embodiment, the cover member 72 is formed of one steel plate. Alternatively, the cover member 72 may be formed of two steel plates. For example, a steel plate recessed in the +X direction and a steel plate recessed in the −X direction may be joined together.

[14. Technical Idea Obtained from Embodiment]

Technical ideas that can be grasped from the above embodiments will be described below.

An aspect of the present invention is the casting mold 40 comprising the cavity 64 for molding a product, and the pouring basin 60 and the passageway 62 that guide molten metal into the cavity 64, wherein the passageway 62 includes, at a portion thereof positioned below the pouring basin 60 and the cavity 64, the bent portion (the first bent portion 66, the second bent portion 68) that changes the advancing direction of the molten metal, and the casting mold further comprises the cover member 72, which covers the inner wall of the bent portion, allows the passageway 62 positioned on the upstream side of the bent portion to communicate with the passageway 62 positioned on the downstream side of the bent portion, and has a lower thermal conductivity than the base material of the mold.

In the above-described configuration, the cover member 72 is provided inside the bent portion (the first bent portion 66 and the second bent portion 68) of the passageway 62 where the molten metal tends to stagnate. The thermal conductivity of the cover member 72 is lower than the thermal conductivity of the casting mold 40. According to the above configuration, the cover member 72 suppresses temperature rise and expansion of the bent portion. Therefore, the cover member 72 can suppress the occurrence of cracks in the bent portion. Further, the cover member 72 can suppress the extension of the cracks. As a result, the number of maintenance operations due to adhesion of metal is reduced. Further, the life of the casting mold 40 is extended. Furthermore, according to the above configuration, the protective member covering the entire passageway 62 is not provided in the passageway 62, but the cover member 72 is provided only in the bent portion. Therefore, the cost for protecting the mold is reduced. In addition, the cover member 72 can be easily replaced.

In the above-described aspect, the passageway 62 may extend downward from the pouring basin 60 and be bent in the lateral direction at the bent portion (the first bent portion 66), and the cover member 72 may have a bottomed cylindrical shape having an axis A extending in the up-down direction, include the upper hole 78 provided at an upper end thereof and opening upward, and include the lateral hole 80 provided on a side wall thereof and opening in the lateral direction.

In the above configuration, the cover member 72 is provided in the first bent portion 66 located below the pouring basin 60. The first bent portion 66 is a portion where the molten metal poured from the pouring basin 60 first stagnates. According to the above configuration, the cover member 72 is provided in the first bent portion 66 where cracks are most likely to occur. Therefore, the casting mold 40 is hardly damaged. As a result, the number of maintenance operations of the casting mold 40 is reduced. Further, the life of the casting mold 40 is extended.

In the above-described aspect, the passageway 62 may be formed with the cover housing portion 90 that houses the cover member 72 from the bent portion (the first bent portion 66, the second bent portion 68) over a predetermined range on the upstream side of the bent portion, the inner diameter of the cover housing portion 90 may be larger than the inner diameter of the passageway 62 positioned on the upstream side of the predetermined range, and the inner diameter of the cover member 72 may be equal to or larger than the inner diameter of the passageway 62 positioned on the upstream side of the predetermined range.

In the above configuration, the inner diameter of the cover housing portion 90 is larger than the inner diameter of the passageway 62 positioned on the upstream side of the predetermined range. This makes positioning of the cover member 72 easy when mounting the cover member 72 in the mold (the fixed mold 42 or the movable mold 44). In the above configuration, the inner diameter of the cover member 72 is equal to or larger than the inner diameter of the passageway 62 positioned on the upstream side of the predetermined range. Therefore, the cover member 72 does not hinder the flow of the molten metal.

In the above aspect, the casting mold may further include a mold main body (first mold 50) and a plurality of partial molds (second mold 52 to fifth mold 58) attached to the mold main body, the passageway 62 may be formed by arranging the plurality of partial molds along the direction of the flow of the molten metal, and the cover housing portion 90 may be formed across the plurality of partial molds (third mold 54 to fifth mold 58).

In the above configuration, the cover housing portion 90 is formed across the plurality of partial molds (the third mold 54 to the fifth mold 58). According to the above configuration, the cover member 72 covers the abutment portions (the first abutment portion 92 to the third abutment portion 96) between the partial molds included in the cover housing portion 90. Therefore, the cover member 72 prevents the molten metal from entering the abutment portion. When the molten metal enters the abutment portion between the partial molds, it is difficult to separate the partial molds from each other. Further, burrs are generated. By suppressing the entry of the molten metal into the abutment portion, the partial molds can be easily separated from each other. In addition, the number of deburring steps is reduced.

In the above aspect, the passageway 62 may extend downward from the pouring basin 60 to the first bent portion 66, be bent in the lateral direction at the first bent portion 66, extend in the lateral direction from the first bent portion 66 to the second bent portion 68, be bent upward at the second bent portion 68, and extend upward from the second bent portion 68 to the cavity 64, and the cover member 72 may be provided on at least one of the first bent portion 66 and the second bent portion 68.

The casting mold according to the present invention is not limited to the above-described embodiments, and various configurations can be adopted without departing from the gist of the present invention.

What is claimed is:

1. A casting mold comprising a cavity configured to mold a product, and a pouring basin and a passageway that are configured to guide molten metal into the cavity, wherein the passageway includes, at a portion thereof positioned below the pouring basin and the cavity, at least one bent portion configured to change an advancing direction of the molten metal, the casting mold further comprises a cover member configured to cover an inner wall of the at least one bent portion and allow the passageway positioned on an upstream side of the at least one bent portion to communicate with the passageway positioned on a downstream side of the at least one bent portion, the cover member having a lower thermal conductivity than a base material of the mold, and the passageway includes a cover housing portion configured to house the cover member from the at least one bent portion over a predetermined range on the upstream side of the at least one bent portion, and a gap is formed between an inner wall of the cover housing portion and an outer wall of the cover member.

2. The casting mold according to claim 1, wherein the passageway extends downward from the pouring basin and is bent in a lateral direction at the at least one bent portion, and the cover member has a bottomed cylindrical shape having an axis extending in an up-down direction, includes an upper hole provided at an upper end thereof and opening upward, and includes a lateral hole provided on a side wall thereof and opening in the lateral direction.

3. The casting mold according to claim 1, wherein an inner diameter of the cover housing portion is larger than an inner diameter of the passageway positioned on an upstream side of the predetermined range, and an inner diameter of the cover member is equal to or larger than the inner diameter of the passageway positioned on the upstream side of the predetermined range.

4. The casting mold according to claim 3, further comprising:

a mold main body; and a plurality of partial molds attached to the mold main body, wherein the passageway is formed by arranging the plurality of partial molds along a direction of flow of the molten metal, and the cover housing portion is formed across a part of the plurality of partial molds or all of the plurality of partial molds.

5. The casting mold according to claim 1, wherein the at least one bent portion includes a first bent portion and a second bent portion, the passageway extends downward from the pouring basin to the first bent portion, is bent in a lateral direction at the first bent portion, extends in the lateral direction from the first bent portion to the second bent portion, is bent upward at the second bent portion, and extends upward from the second bent portion to the cavity, and the cover member is provided in at least one of the first bent portion and the second bent portion.

* * * * *